US007578283B1

(12) United States Patent
Bartley

(10) Patent No.: US 7,578,283 B1
(45) Date of Patent: Aug. 25, 2009

(54) SYSTEM FOR SELECTIVELY INCREASING FUEL PRESSURE IN A FUEL INJECTION SYSTEM

(75) Inventor: Bradley E. Bartley, Pekin, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/216,117

(22) Filed: Jun. 30, 2008

(51) Int. Cl.
*F02M 37/04* (2006.01)

(52) U.S. Cl. ..... 123/446; 123/510

(58) Field of Classification Search ..... 123/446, 123/447, 467, 510, 511; 239/88–96
See application file for complete search history.

(56) References Cited

U.S. PATENT DOCUMENTS

| | | | | |
|---|---|---|---|---|
| 4,069,800 | A * | 1/1978 | Kanda et al. | 123/447 |
| 4,219,154 | A | 8/1980 | Luscomb | |
| 4,222,358 | A * | 9/1980 | Hofbauer | 123/495 |
| 4,364,360 | A * | 12/1982 | Eheim et al. | 123/450 |
| 4,440,132 | A * | 4/1984 | Terada et al. | 123/446 |
| 4,624,233 | A | 11/1986 | Phillips | |
| 4,793,589 | A | 12/1988 | Eldredge et al. | |
| 5,622,152 | A * | 4/1997 | Ishida | 123/446 |
| 6,805,101 | B2 | 10/2004 | Magel | |
| 6,868,831 | B2 | 3/2005 | Lei | |
| 7,032,574 | B2 | 4/2006 | Sturman | |
| 7,066,151 | B1 | 6/2006 | Bos | |
| 7,182,070 | B2 | 2/2007 | Magel | |
| 7,278,398 | B2 | 10/2007 | Magel | |
| 2004/0003794 | A1 | 1/2004 | Mahr et al. | |
| 2005/0172935 | A1 | 8/2005 | Magel et al. | |
| 2005/0263133 | A1 | 12/2005 | Magel | |
| 2006/0090734 | A1 | 5/2006 | Magel | |
| 2007/0095934 | A1 | 5/2007 | Wisdom | |
| 2007/0175448 | A1 | 8/2007 | Shinogle et al. | |
| 2008/0087738 | A1 | 4/2008 | Sturman | |

* cited by examiner

*Primary Examiner*—Thomas N Moulis
(74) *Attorney, Agent, or Firm*—Finnegan, Henderson, Farabow, Garrett & Dunner

(57) ABSTRACT

An assembly is disclosed having a high pressure fuel source, a low pressure fuel source, and a housing. The assembly also has a piston disposed within the housing and dividing the housing into a first chamber, a second chamber, a third chamber, and a fourth chamber. The first and second chambers are fluidly connected to the high pressure fuel source. The third chamber is selectively fluidly connected to the high pressure fuel source and the low pressure fuel source, and the fourth chamber is fluidly connected to the low pressure fuel source. The piston is movable from a first position when the third chamber is selectively connected to the high pressure fuel source. The piston is movable to a second position when the third chamber is selectively connected to the low pressure fuel source.

20 Claims, 2 Drawing Sheets

SYSTEM FOR SELECTIVELY INCREASING FUEL PRESSURE IN A FUEL INJECTION SYSTEM

TECHNICAL FIELD

The present disclosure is directed to a fuel injector and, more particularly, to a system for selectively increasing fuel pressure in a fuel injection system.

BACKGROUND

Some engines, such as diesel engines, rely on compression ignition by compressing air and injecting fuel into the compressed air to substantially immediately ignite the fuel without requiring a spark plug. Compression ignition engines may include a common rail fuel injection system, directing pressurized fuel to individual fuel injectors for injection into the combustion chamber. Fuel injection systems may utilize a system that selectively increases the pressure at which fuel is injected into the combustion chamber. Such a system may include a piston disposed within a chamber for increasing the pressure of fuel. The chamber may be fluidly connected to the nozzle of the fuel injector. The piston may be selectively displaced to force an additional volume of fuel into the fuel injector nozzle, thereby increasing the pressure of fuel injected into the combustion chamber. Typically, the piston is displaced to increase fuel pressure via a solenoid assembly and returned to its initial position via a spring.

U.S. Pat. No. 6,805,101 B2 (the '101 patent), issued to Magel, describes a piston for selectively increasing a pressure of a fuel injection system. The piston divides a housing into two separate chambers. The piston selectively displaces within the housing to increase the pressure of fuel within one of the chambers. The system of the '101 patent includes a restoring spring that returns the piston to an initial position.

Although the fuel injection system of the '101 patent may provide a method for providing fuel to a combustion chamber at an increased pressure, it requires additional components such as, for example, the restoring spring that may increase manufacturing costs. Also, these additional components may experience wear due to high pressures associated with increasing the fuel pressure.

The present disclosure is directed to overcoming one or more of the shortcomings set forth above.

SUMMARY OF THE DISCLOSURE

In accordance with one aspect, the present disclosure is directed toward an assembly. The assembly includes a high pressure fuel source, a low pressure fuel source, and a housing. The assembly also includes a piston disposed within the housing and dividing the housing into a first chamber, a second chamber, a third chamber, and a fourth chamber. The first and second chambers are fluidly connected to the high pressure fuel source. The third chamber is selectively fluidly connected to the high pressure fuel source and the low pressure fuel source, and the fourth chamber is fluidly connected to the low pressure fuel source. The piston is movable from a first position when the third chamber is selectively connected to the high pressure fuel source. The piston is movable to a second position when the third chamber is selectively connected to the low pressure fuel source.

According to another aspect, the present disclosure is directed toward a method for selectively increasing fuel pressure in a fuel injection system. The method includes displacing a piston within a housing, the piston and housing forming a first chamber, a second chamber, a third chamber, and a fourth chamber. The method also includes supplying fuel at a first pressure to the first chamber and the second chamber. The method additionally includes supplying fuel at a second pressure to the fourth chamber, the first pressure being greater than the second pressure. The method also includes selectively supplying fuel at the first pressure to the third chamber to displace the piston to a first position. The method additionally includes selectively supplying fuel at the second pressure to the third chamber to displace the piston to a second position.

DETAILED DESCRIPTION

Figure 1:
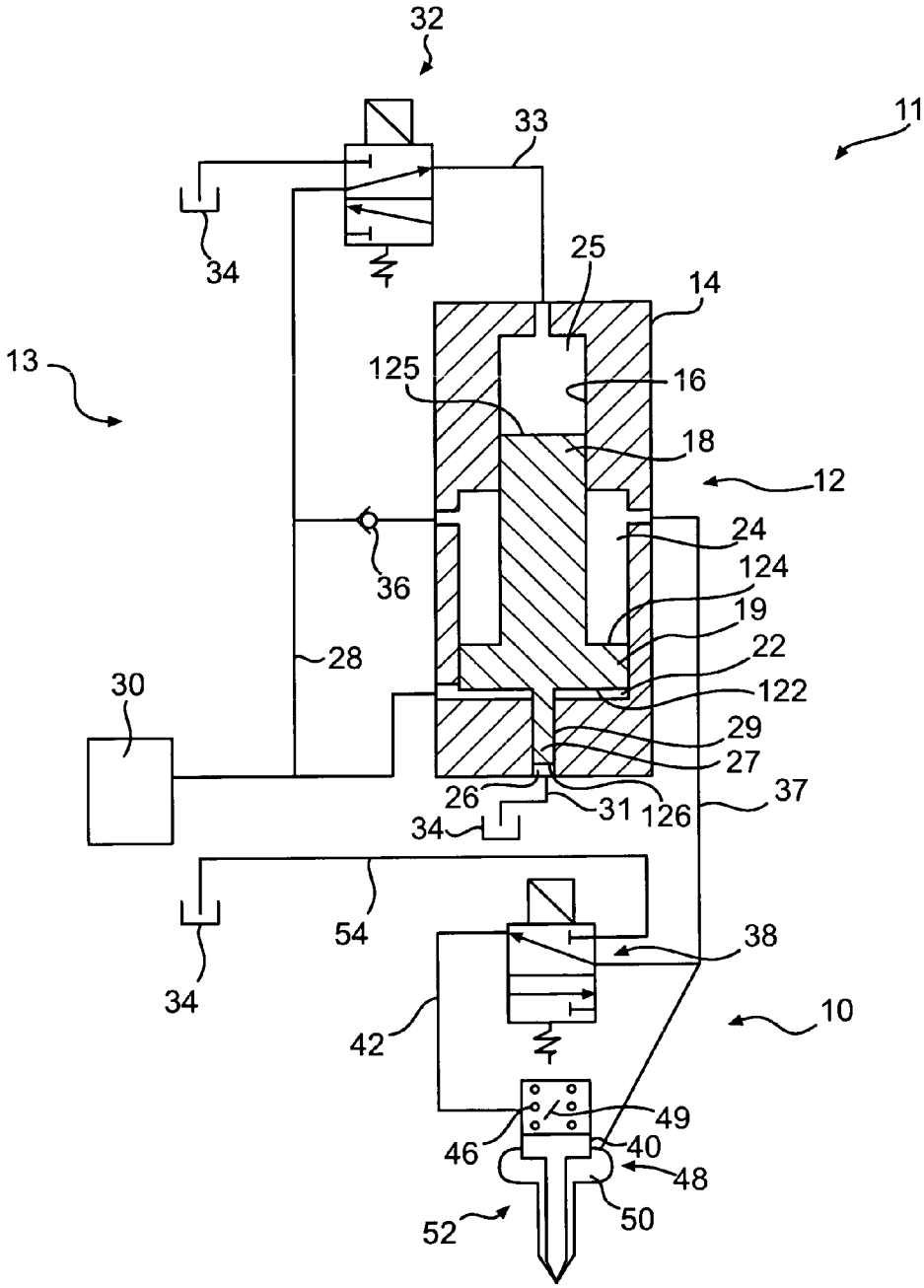
FIG. 1 is a schematic illustration of an exemplary fuel injection system with a piston in a first position.

FIG. 1 illustrates an exemplary fuel injection system 11 for delivering fuel to an engine. Fuel injection system 11 may be operable to inject an amount of pressurized fuel into a combustion chamber of an associated engine at predetermined timings, fuel pressures, and fuel flow rates. The engine may include, for example, a four-stroke diesel engine or a gaseous fuel-powered engine. The engine may be a compression ignition engine and may include an engine block that at least partially defines a plurality of cylinders, a piston slidably disposed within each cylinder, and a cylinder head associated with each cylinder. The cylinder, piston, and cylinder head may form the combustion chamber. The engine may be associated with a machine such as, for example, a mobile or stationary machine that performs some type of operation associated with an industry such as mining, construction, farming, power generation, or transportation. Fuel injection system 11 may include a fuel injector component 10 and a pressure system 13. Pressure system 13 may pressurize fuel and provide the pressurized fuel to fuel injector component 10 for injection into the combustion chamber of the engine. Although depicted as separate structures in FIGS. 1 and 2, pressure system 13 and fuel injector component 10 may be positioned in a single fuel injector structure, thereby eliminating any fuel lines extending between pressure system 13 and fuel injector component 10 outside of the fuel injector structure.

Pressure system 13 may include a control valve 32, a fuel source 30, and an assembly 12. Fuel source 30 may provide pressurized fuel to assembly 12 and control valve 32 may affect an increase of pressure of the fuel in assembly 12. Assembly 12 may thereby selectively deliver fuel at an increased pressure to fuel injector component 10.

Figure 2:
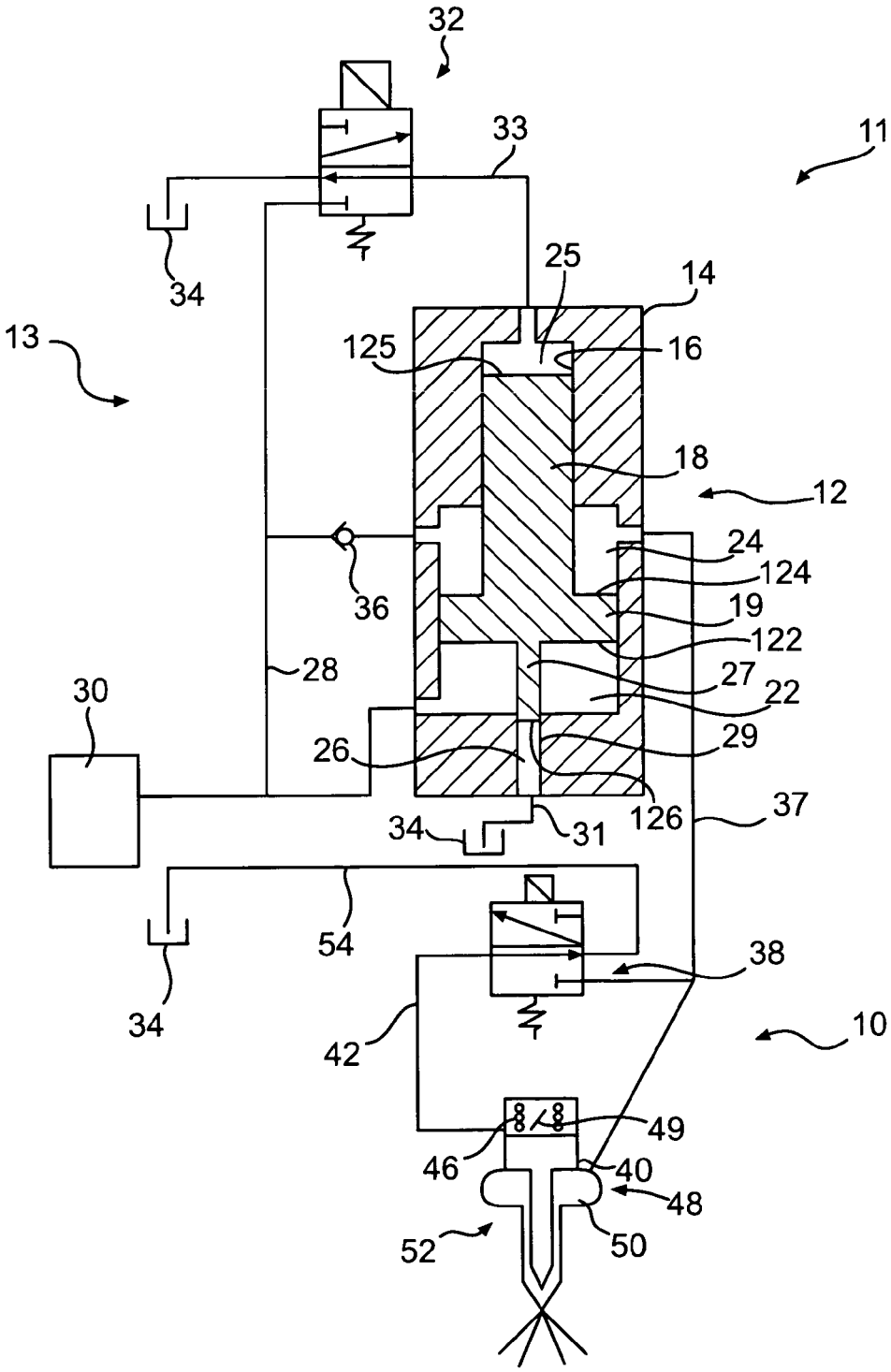
FIG. 2 is a schematic illustration of the fuel injection system of FIG. 1 with the piston in a second position.

Assembly 12 may include a piston 18 disposed within an internal chamber 16 of a housing 14. Piston 18 may be substantially T-shaped or may alternatively be another suitable shape for increasing pressure of fuel and may have a piston head 19 disposed at one end. Piston 18 may separate internal chamber 16 into a first chamber 22, a second chamber 24, a third chamber 25, and a fourth chamber 26. Piston 18 may be displaceable between a first position, as shown in FIG. 1, and a second position, as shown in FIG. 2.

First chamber 22 may be formed by piston head 19 and inner walls of housing 14. The side of first chamber 22 bounded by piston head 19 may form a first pressure area 122. The high pressure fuel in first chamber 22 may apply a first force on piston 18 via first pressure area 122. A volume of first chamber 22 may increase from a relatively smaller volume when piston 18 is in the first position (shown in FIG. 1) to a relatively larger volume when piston 18 is in the second position (shown in FIG. 2). First chamber 22 of assembly 12 is fluidly connected to high pressure fuel source 30. Fuel source 30 may provide a substantially continuous supply of high pressure fuel to first chamber 22 via fuel line 28.

Second chamber 24 may be formed between side walls of piston 18 and inner walls of housing 14. The side of second chamber 24 bounded by piston head 19 may form a second pressure area 124. The pressurized fuel in second chamber 24 may apply a second force on piston 18 via second pressure area 124. A volume of second chamber 24 may decrease from a relatively larger volume when piston 18 is in the first position (shown in FIG. 1) to a relatively smaller volume when piston 18 is in the second position (shown in FIG. 2). Second chamber 24 of assembly 12 is fluidly connected to high pressure fuel source 30 via fuel line 28. A one-way valve 36 may allow high pressure fuel to flow from high pressure fuel source 30 to second chamber 24 while substantially preventing fuel from flowing from second chamber 24 to fuel source 30. One-way valve 36 may be a ball check valve or another suitable valve known in the art. Second chamber 24 may also be fluidly connected to fuel injector component 10 via a fuel line 37. An outer diameter of piston head 19 may be substantially equal to an inner diameter of the walls defining second chamber 24 so that piston head 19 may substantially block fuel within second chamber 24 from entering first chamber 22.

Third chamber 25 may be formed between an end of piston 18 and inner walls of housing 14. The side of third chamber 25 bounded by piston 18 may form a third pressure area 125. A volume of third chamber 25 may decrease from a larger volume when piston 18 is in the first position (shown in FIG. 1) to a smaller volume when piston 18 is in the second position (shown in FIG. 2). The fuel in third chamber 25 may apply a third force on piston 18 via third pressure area 125. Control valve 32 may fluidly connect high pressure fuel source 30 to third chamber 25 via fuel line 28 and a fuel line 33 when in the first position (shown in FIG. 1) and may fluidly connect third chamber 25 to a low pressure fuel source 34 via fuel line 33 when in the second position (shown in FIG. 2). High pressure fuel may fill third chamber 25 when control valve 32 is in the first position and high pressure fuel may be relieved from third chamber 25 to low pressure fuel source 34 when control valve 32 is in the second position. Therefore, when control valve 32 is in the first position, the third force may be significantly larger than when control valve 32 is in the second position. An outer diameter of piston 18 may be substantially equal to an inner diameter of the inner walls of housing 14 so that piston 18 may substantially block fuel within third chamber 25 from entering second chamber 24.

Piston 18 may include an extension 27 that may be integrally attached to an end of piston head 19. Fourth chamber 26 may be formed by a bore 29 formed in housing 14. Bore 29 may be configured to receive extension 27 of piston 18. The side of fourth chamber 26 bounded by extension 27 may form a fourth pressure area 126. An outer diameter of extension 27 may be substantially equal to an inner diameter of bore 29 so that extension 27 may substantially block fuel within first chamber 22 from entering fourth chamber 26. A volume of fourth chamber 26 may increase from a relatively smaller volume when piston 18 is in the first position (shown in FIG. 1) to a relatively larger volume when piston 18 is in the second position (shown in FIG. 2). Fourth chamber 26 may be fluidly connected to low pressure fuel source 34 via a fuel line 31. Low pressure fuel from low pressure fuel source 34 may apply a fourth force on piston 18 via fourth pressure area 126. The fourth force may be substantially smaller than the first, second, and third forces.

The dimensions of pressure areas 122, 124, 125, and 126 may affect a pressure imbalance on piston 18 and may thereby affect the position of piston 18. As dimensions of fourth pressure area 126 increase, dimensions of first pressure area 122 may correspondingly decrease. Fourth pressure area 126 may be dimensioned large enough so that a sum of second pressure area 124 and third pressure area 125 may be greater than first pressure area 122. First pressure area 122 and fourth pressure area 126 may also be dimensioned so that first pressure area 122 may be greater than second pressure area 124 alone. When control valve 32 is in the first position, high pressure fuel from high pressure fuel source 30 is in first chamber 22, second chamber 24, and third chamber 25, thereby establishing the first, second, and third forces, respectively. Low pressure fuel from low pressure fuel source 34 is in fourth chamber 26, thereby establishing the fourth force. When control valve 32 is in the first position, the first, second, and third forces are substantially higher than the fourth force. A sum of the second force from second pressure area 124 and the third force from third pressure area 125 may be greater than a sum of the first force from first pressure area 122 and the fourth force from fourth pressure area 126 and piston 18 may be consequently displaced to the first position (shown in FIG. 1). When control valve 32 is in the second position, high pressure fuel from high pressure fuel source 30 is in first chamber 22 and second chamber 24, thereby establishing the first and second forces, respectively. Low pressure fuel from low pressure fuel source 34 is in third chamber 25 and fourth chamber 26, thereby establishing the third and fourth forces, respectively. When control valve 32 is in the second position, the first and second forces may be substantially higher than the third and fourth forces. A sum of the first force from first pressure area 122 and the fourth force from fourth pressure area 126 may be greater than a sum of the second force from second pressure area 124 and the third force from third pressure area 125 and piston 18 may be consequently displaced to the second position (shown in FIG. 2).

In operation, control valve 32 may selectively connect third chamber 25 to low pressure fuel source 34 or to high pressure fuel source 30. Low pressure fuel source 34 may provide fuel having a fuel pressure that is substantially less than the fuel pressure of the fuel provided by high pressure fuel source 30. Control valve 32 may be a solenoid-actuated and spring-biased control valve that is movable between the first position and the second position. Control valve 32 may alternatively be hydraulically actuated, mechanically actuated, pneumatically actuated, or actuated in any other suitable manner. When control valve 32 is positioned in the first position (shown in FIG. 1), high pressure fuel source 30 is fluidly connected to third chamber 25 via fuel lines 28 and 33. When control valve 32 is positioned in the second position (shown in FIG. 2), low pressure fuel source 34 is fluidly connected to third chamber 25 via fuel line 33.

High pressure fuel source 30 may be any suitable fuel source known in the art for providing high pressure fuel such as, for example, a common rail that is supplied via a high pressure fuel pump. It is contemplated that high pressure fuel source 30 may alternatively be a high pressure fuel accumulator. Fuel source 30 is fluidly connected to first chamber 22 and second chamber 24 via fuel line 28 and is selectively fluidly connected to third chamber 25 via control valve 32 and fuel line 33.

Fuel injector component 10 may include a control valve 38 and a nozzle assembly 52. Control valve 38 may direct fuel to nozzle assembly 52 to selectively block and allow fuel injection into the combustion chamber.

Nozzle assembly 52 may include a nozzle chamber 48, a spring 46, and a nozzle piston 40. Nozzle piston 40 may be T-shaped or any other shape suitable for fuel injection. Nozzle piston 40 may be disposed in nozzle chamber 48 and may separate nozzle chamber 48 into a check cavity 49 and a nozzle cavity 50. Nozzle cavity 50 may be fluidly connected to second chamber 24 via fuel line 37. Nozzle piston 40 may move between a first position, substantially blocking fuel injection as illustrated in FIG. 1, and a second position, allowing fuel injection as illustrated in FIG. 2. In the first position, shown in FIG. 1, nozzle piston 40 may prevent fuel from being injected from nozzle cavity 50 into the combustion chamber. In the second position, shown in FIG. 2, nozzle piston 40 may allow fuel injection from nozzle cavity 50 into the combustion chamber. Spring 46 may urge nozzle piston 40 toward the closed position.

Control valve 38 may be similar to control valve 32 and may be fluidly connected to second chamber 24 via fuel line 37. Control valve 38 may be movable to a first position, as shown in FIG. 1, fluidly connecting second chamber 24 to check cavity 49 via fuel line 37 and a fuel line 42. In the first position, pressurized fuel from second chamber 24, and a biasing force from spring 46, may urge nozzle piston 40 into the first position substantially blocking fuel injection, as shown in FIG. 1. Control valve 38 may be movable to a second position, as shown in FIG. 2, fluidly connecting check cavity 49 to low pressure fuel source 34 via fuel line 42 and a fuel line 54. In the second position, pressure may be relieved from check cavity 49 and a pressure in nozzle cavity 50 may overcome the bias in spring 46, thereby displacing nozzle piston 40 to a second position, allowing fuel injection, as shown in FIG. 2.

INDUSTRIAL APPLICABILITY

Fuel injection system 11 may operate to selectively increase the pressure of fuel injected into the combustion chamber of the engine. During fuel injection into the combustion chamber, fuel injection system 11 may selectively operate to increase the injected fuel to a higher pressure than during normal injection. Fuel injection system may selectively increase the pressure of fuel by affecting a displacement of piston 18 of assembly 12.

As shown in FIG. 1, control valve 32 is in the first position, thereby allowing fuel from high pressure fuel source 30 to enter third chamber 25 via fuel lines 28 and 33. High pressure fuel source 30 also supplies high pressure fuel to second chamber 24 via fuel line 28. When control valve 32 is in the first position, first pressure area 122, second pressure area 124, and third pressure area 125 may be affected by a substantially higher pressure than fourth pressure area 126. A pressure imbalance may result and may act on piston 18. A sum of the second force from second pressure area 124 and the third force from third pressure area 125 may be greater than a sum of the first force from first pressure area 122 and the fourth force from fourth pressure area 126, and the pressure imbalance may bias piston 18 into the first position.

Control valve 38 may be in the first position and may fluidly connect second chamber 24 to nozzle cavity 50 and check cavity 49. The forces from the fuel within check cavity 49 and spring 46 may be larger than a force from the fuel within nozzle cavity 50, thereby biasing nozzle piston 40 into the first position and substantially blocking fuel injection into the combustion chamber.

Fuel injection system 11 may selectively increase the pressure of fuel injected into the combustion chamber as shown in FIG. 2. Control valve 32 may displace to the second position, thereby fluidly connecting third chamber 25 to low pressure fuel source 34 via fuel line 33 and allowing high pressure fuel to be relieved from third chamber 25. Because control valve 32 is in the second position, a substantially higher pressure may affect first pressure area 122 and second pressure area 124 than third pressure area 125 and fourth pressure area 126. A sum of the first force from first pressure area 122 and the fourth force from fourth pressure area 126 may be greater than a sum of the second force from second pressure area 124 and the third force from third pressure area 125. The pressure imbalance may affect piston 18 to displace to the second position. As piston 18 advances to the second position, piston head 19 may reduce the volume of second chamber 24, thereby increasing a pressure of fuel in second chamber 24. One-way valve 36 may substantially prevent flow from second chamber 24 toward fuel line 28 and pressurized fuel may flow from second chamber 24 through fuel line 37 toward fuel injector component 10. The pressurized fuel exiting second chamber 24 may have a higher pressure than the fuel provided by high pressure fuel source 30.

As piston 18 displaces from the first position to the second position and increases the pressure of fuel in assembly 12, control valve 38 may move to the second position. In the second position, control valve 38 may fluidly connect check cavity 49 to low pressure fuel source 34 via fuel lines 42 and 54. As high pressure fuel is relieved from check cavity 49, the force on nozzle piston 40 from fuel pressure within nozzle cavity 50 may be greater than the force provided by spring 46 and the fuel pressure in check cavity 49, thereby affecting nozzle piston 40 to displace to the second position. In its second position, nozzle piston 40 may allow the pressurized fuel from second chamber 24 to be injected from nozzle cavity 50 into the combustion chamber of the engine.

After the fuel has been injected into the combustion chamber, control valve 32 may move to the first position as shown in FIG. 1. High pressure fuel source 30 again supplies high pressure fuel to third chamber 25 via fuel lines 28 and 33. The magnitude of the third force due to third pressure area 125 resulting from the return of high pressure fuel to third chamber 25 may increase so that the sum of the second and third forces may be larger than the sum of the first and fourth forces. These forces may affect piston 18 to return to the first position, shown in FIG. 1, without the need for any spring or other biasing mechanism.

The above described cycle of selectively increasing the pressure of fuel may be repeated as desired. It is also contemplated that fuel injection may occur without selectively increasing the pressure of fuel. Fuel injection system 11 may inject fuel into the combustion chamber when control valve 32 is in the first position and control valve 38 is in the second position, allowing fuel injection into the combustion chamber without increasing the pressure of fuel injection via a displacement of piston 18.

Fuel injection system 11 may provide a method for returning piston 18 to the first position via a pressure imbalance acting on piston 18. Therefore, fuel injection system 11 may eliminate the need for a conventional restoring spring or other biasing mechanism that is typically used when increasing fuel injection pressures.

It will be apparent to those skilled in the art that various modifications and variations can be made to the disclosed fuel injection system. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. An assembly, comprising:

a high pressure fuel source;

a low pressure fuel source;

a housing; and a piston disposed within the housing and dividing the housing into a first chamber, a second chamber, a third chamber, and a fourth chamber, the first and second chambers being fluidly connected to the high pressure fuel source, the third chamber being selectively fluidly connected to the high pressure fuel source and the low pressure fuel source, and the fourth chamber being fluidly connected to the low pressure fuel source, the piston movable from a first position, when the third chamber is selectively connected to the high pressure fuel source, to a second position, when the third chamber is selectively connected to the low pressure fuel source.

2. The assembly of claim 1, further including a first control valve for selectively connecting the third chamber to the high pressure fuel source or the low pressure fuel source.

3. The assembly of claim 1, further including a bore disposed within the housing and receiving an extension attached to the piston, the bore and the extension forming the fourth chamber.

4. The assembly of claim 1, wherein when the third chamber is selectively connected to the high pressure fuel source, pressures within the second and third chambers acting on the piston are greater than pressures within the first and fourth chambers acting on the piston, wherein a pressure imbalance is created to bias the piston into the first position.

5. The assembly of claim 1, wherein when the third chamber is selectively connected to the low pressure fuel source, pressures within the second and third chambers acting on the piston are less than pressures within the first and fourth chambers acting on the piston, wherein a pressure imbalance is created to bias the piston into the second position.

6. The assembly of claim 1, wherein a pressure of fuel within the second chamber increases when the piston displaces from the first position to the second position.

7. The assembly of claim 1, further including a check valve disposed between the second chamber and the high pressure fuel source, the check valve configured to allow fuel flow from the high pressure fuel source to the second chamber and substantially prevent fuel flow from the second chamber to the high pressure fuel source.

8. The assembly of claim 1, further including a fuel injector component fluidly connected to the second chamber, the fuel injector component configured to inject fuel from the second chamber at an increased pressure into a combustion chamber of an engine after the piston moves from the first position to the second position.

9. A method for selectively increasing fuel pressure in a fuel injection system, comprising:

displacing a piston within a housing, the piston and the housing forming a first chamber, a second chamber, a third chamber, and a fourth chamber;

supplying fuel at a first pressure to the first chamber and the second chamber;

supplying fuel at a second pressure to the fourth chamber, the first pressure greater than the second pressure;

selectively supplying fuel at the first pressure to the third chamber to displace the piston to a first position; and selectively supplying fuel at the second pressure to the third chamber to displace the piston to a second position.

10. The method of claim 9, further including controlling a control valve to selectively supply fuel to the third chamber.

11. The method of claim 9, further including biasing the piston to the first position by supplying fuel at the first pressure to the third chamber such that pressures within the second and third chambers acting on the piston are greater than pressures within the first and fourth chambers acting on the piston.

12. The method of claim 9, further including biasing the piston to the second position by supplying fuel at the second pressure to the third chamber such that pressures within the first and fourth chambers acting on the piston are greater than pressures within the second and third chambers acting on the piston.

13. The method of claim 9, further including selectively increasing a pressure of fuel within the second chamber by displacing the piston from the first position to the second position.

14. The method of claim 9, further including selectively injecting pressurized fuel from the second chamber into a combustion chamber via a fuel injector component after the piston displaces from the first position to the second position.

15. The method of claim 14, further including controlling a control valve to selectively inject fuel into the combustion chamber.

16. A fuel injection system, comprising:

a high pressure fuel source;

a low pressure fuel source;

a housing;

a piston disposed within the housing and dividing the housing into a first chamber, a second chamber, a third chamber, and a fourth chamber, the first and second chambers being fluidly connected to the high pressure fuel source, the third chamber being selectively fluidly connected to the high pressure fuel source and the low pressure fuel source, and the fourth chamber being fluidly connected to the low pressure fuel source, the piston movable from a first position, when the third chamber is selectively connected to the high pressure fuel source, to a second position, when the third chamber is selectively connected to the low pressure fuel source;

a fuel injector component having a first cavity and a second cavity, the first cavity fluidly connected to the second chamber;

a first control valve that selectively connects the second chamber to the second cavity and selectively connects the second cavity to the low pressure fuel source; and a nozzle element disposed between the first and second cavities.

17. The fuel injection system of claim 16, wherein fuel is injected into a combustion chamber of an engine when the first control valve connects the second cavity to the low pressure fuel source.

18. The fuel injection system of claim 16, wherein the fuel injector component selectively injects fuel into a combustion chamber at a first pressure when the piston is in the first position and at a second pressure when the piston is in the second position.

19. The fuel injection system of claim 16, wherein the piston is returned from the second position to the first position by a pressure imbalance acting on the piston.

20. The fuel injection system of claim 16, further including a second control valve for selectively connecting the third chamber to the high pressure fuel source or the low pressure fuel source.

* * * * *